US005088170A

United States Patent [19]

Späth

[11] Patent Number: 5,088,170

[45] Date of Patent: Feb. 18, 1992

[54] DEVICE FOR MANUFACTURING EXPANDED MATERIAL

[76] Inventor: Michael M. Späth, Oberachweg 7, D-8183 Rottach-Egern, Fed. Rep. of Germany

[21] Appl. No.: 455,345

[22] PCT Filed: Apr. 26, 1989

[86] PCT No.: PCT/EP89/00460

§ 371 Date: Feb. 28, 1990

§ 102(e) Date: Feb. 28, 1990

[87] PCT Pub. No.: WO89/10219

PCT Pub. Date: Nov. 2, 1989

[30] Foreign Application Priority Data

Apr. 28, 1988 [DE] Fed. Rep. of Germany ..... 3814448

[51] Int. Cl.[5] ..... B21D 31/04

[52] U.S. Cl. ..... 29/6.1

[58] Field of Search ..... 29/6.1, 6.2, 2

[56] References Cited

U.S. PATENT DOCUMENTS 4,486,927 12/1984 Hunter et al. ..... 29/6.1
4,621,397 11/1986 Schrenk ..... 29/6.1
4,649,607 3/1987 Kuhn, II ..... 29/6.1
4,881,307 11/1989 Gaissmaier ..... 29/6.1
4,921,118 5/1990 Gass ..... 29/6.1 X

*Primary Examiner*—Timothy V. Eley
*Attorney, Agent, or Firm*—Dykema Gossett

[57] ABSTRACT

A device is disclosed for producing expanded material using cutting rollers of special design, in which the individual annular cutting rings on the cutting rollers are provided with notches in their lateral surfaces, and when the cutting roller is viewed from above, these notches are seen to be trapezoidal in shape. The invention relates furthermore to the special configuration of the stretching system, wherein the strip-shaped non-stretched material passing through is gripped laterally by two toothed belts while at the same time the material to be stretched runs up, in its center section, on a recirculating element, such as a rounde-section belt running at an appropriate speed. This belt rises far enough out of the plane of the toothed belts that the desired transverse stretching of the material is achieved. By "expanded material" is meant a foil-like material, usually metal, in which a large number of parallel-oriented incisions are made, so that this material can then be pulled apart transversely to the direction of the incisions; as a result, the material is shortened in the longitudinal direction and the webs of material left between the incisions create a more or less three-dimensional lattice.

14 Claims, 3 Drawing Sheets

DEVICE FOR MANUFACTURING EXPANDED MATERIAL

Figure 1:
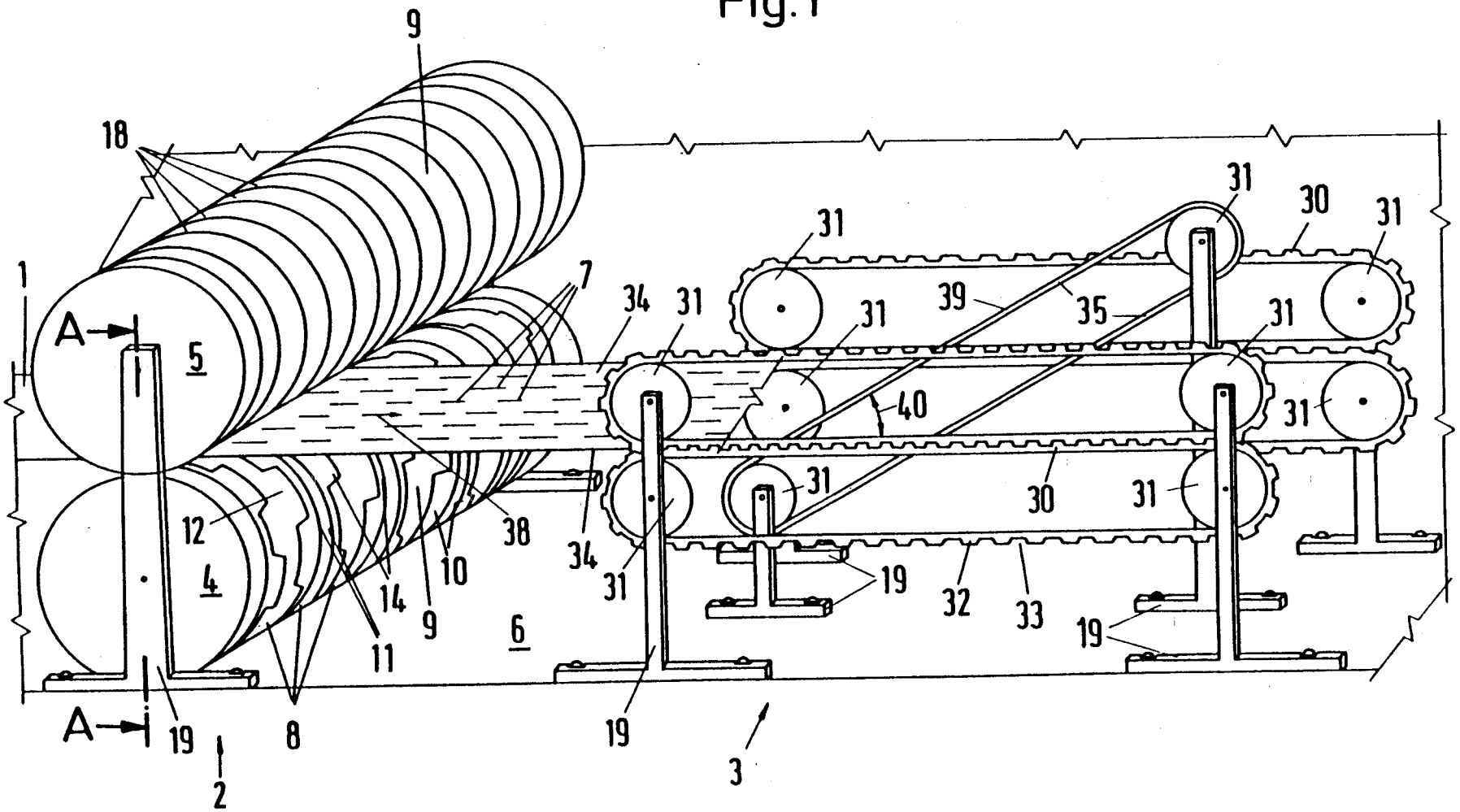

The present invention relates to a device expanded material from foil, in particular expanded metal from aluminium foil. The device comprises a cutting unit for the continuous production of individual, discontinuous incisions in a foil, the cutting unit consisting of a cutting roller and a pressure roller, said device further comprising stretching means for expanding the cut foil transversely to the longitudinal direction of the cuts.

Expanded metals are thin strips or foils, usually of metal, which, to start with, are provided with a large number of discontinuous incisions before being expanded, i.e. stretched, transversely to the longitudinal direction of these incisions; the result is that the strips of metal which were previously located between the incisions are expanded to form a lattice structure. If this lattice is located in the same plane as was previously the metal foil in its starting condition, then the lattice is broader and shorter than the foil in the starting situation relative to the direction of the incisions in the foil, which is taken as the longitudinal direction. In addition, metal strips which form the struts of the lattice are located transverse to the plane of the lattice, so that when the latter is viewed from above the struts appear in each case only in the thickness of the original metal foil. When the foil is formed into a lattice, the original longitudinal incisions are converted into mostly honeycomb-like or rhomboidal openings in the latter.

Although the device of the present invention described hereinafter can be used to produce expanded material out of all thin materials, such as plastic, paper, wood and metal, in the following, only the conversion of metal foils into the generally known product "expanded metal" will be considered by way of example.

Such expanded metal is required for a wide variety of applications. For example, if expanded metal is used to provide an explosion-preventing sheath around naked flames, it is sufficient to manufacture it from metal foils which are only a few hundredths of a millimeter thick. When non-metallic starting materials are used, the expanded material can be used as a filter, as a packaging material, as a carrier layer in the construction industry, and for many other purposes. On the other hand, it is possible in the same manner to produce a very stable expanded metal from sheets up to several mm thick and this material can be used, for example, as a platform surface in scaffolding, as a step, or similar. Naturally, many other uses, for example as sieves, peeling knives, and other devices are conceivable.

Therefore to manufacture such expanded metal, it is necessary to use machines which, to start with, are capable of making a large number of defined incisions, all having the same longitudinal orientation, in thin metals, i.e. metal foils; next, these machines must pull the metal foils apart transverse to the longitudinal direction of the incisions, thus making the metal wider, but also shorter and causing it to assume the shape of a honeycomb-like lattice.

Since continuous manufacturing processes are usually more economical than discontinuous processes, a decision was taken at a very early stage to use metal foils in the form of very long metal strips wound up on spools. These strips are provided with the required incisions as they pass between a cutting roller and a pressure roller.

If these incisions run in the longitudinal direction of the metal strip, subsequent expansion must be in the transverse direction of the strip, although the incisions may also be made transversely to the longitudinal direction of the strip, so that the expansion must take place in the longitudinal direction of the strip. Of course, a hybrid form is conceivable in which the incisions run obliquely to the longitudinal direction of the foil strip. For the purpose of the following explanatory remarks, it is assumed that the incisions run longitudinally, i.e. parallel to the longitudinal axis of the strip.

For this purpose, the two rollers are both cylindrical in shape and possess a large number of annular grooves arranged around their circumferential surfaces, between which similarly annular lands remain. In the cutting roller these lands act as cutting rings which, when they enter the grooves of the pressure roller, cause incisions to be made at intervals in the metal foil interposed between the edge of the cutting rings of the cutting roller and the edge of the lands on the pressure roller. In this way, when cutting rings with continuously rectangular cross section, i.e. straight cutting edges, are used, the original metal strip is slit into a number of parallel, narrow metal strips which are not joined with each other. In order to avoid this, the cutting edges on the cutting rings of the cutting roller must be interrupted so that when the cutting rings enter the grooves on the cutting roller only individual sections of the cutting edge slide along very close to the edges of the lands on the pressure roller, thus shearing the metal foil. In the intervening areas of the cutting rings of the cutting roller it must be possible for the metal foil to be pressed by the lands of the cutting roller into the grooves on the drive roller, so that in these areas the metal foil is not sheared.

As the cutting and pressure rollers continue to rotate and the lands and grooves of the two rollers move apart from each other once more, the cut metal foil should not become jammed in the grooves of the pressure roller, but instead must run smoothly out of the grooves without any additional tearing occurring in the metal webs of the cut metal foil.

In the past, attempts have been made to solve this problem by arranging guide brushes and similar devices between the cutting roller and the pressure roller, although this measure usually did not provide optimal results because the metal webs often became caught up in the rectangular recesses in the cutting rings of the cutting rollers, which are needed to interrupt the cutting process at the cutting rings. Once the continuous cutting of the metal foils was complete, it was necessary to continuously stretch the cut foils transversely, at the same time shortening them in the longitudinal direction. To accomplish this, attempts were made to seize the edges of the foil strip emerging from the cutting unit and to transport it onwards, while at the same time stretching it in the transverse direction by ensuring that these gripping devices did not run parallel but moved apart; alternatively, the stretching was brought about by arranging a movable or immovable obstacle projecting at an angle upwards from the plane of the foil and arranged between the gripping devices at the edge of the foil; while being transported longitudinally, the metal foil was forced to run up onto this obstacle so that the straight and short transverse connection between the edges of the metal foil ceased to exist and in this way, or by a combination of both methods, the metal foil was stretched transversely to the longitudinal direction. When this obstacle was of the immovable type, it usually took the form of a nose-shaped ramp. However, in this case friction was generated between the ramp and the metal foil, so that frequently deformation or tearing of the metal strip was caused, or no stretching took place because the material was torn out of the lateral guides.

In addition, it was no longer possible to satisfactorily solve the problem of gripping the edges of the metal foil because, for example, the edge zone of the foil strip tore off or it slipped out of the lateral engagement between the conveyor chains. For this purpose, in the past it has been the practise to arrange two Reinolds conveyor chains in close contact with each other, one above and one below the metal foil, gripping the latter and transporting it in the longitudinal direction.

Apart from the fact that such Reinolds conveyor chains are relatively expensive, they were exposed to a considerable amount of wear, which resulted in frequent interruptions of the operation of the stretching unit in order to replace these chains; and, furthermore, the metal foils were frequently not adequately held by these chains because the metal foil was either damaged by the Reinolds conveyor chains or the grip between the chains was not firm enough to permit stretching in a transverse direction because the metal foil was simply pulled out of the two chains.

It is therefore the task of the invention to make available a device for manufacturing expanded material which operates smoothly and satisfactorily, and which in particular avoids the aforementioned disadvantages of the state of the art technology.

This task is solved by making improvements to the cutting unit as well as to the stretching unit.

The cuts in the metal foil, which are generated by the cutting edges of the cutting rings on the cutting roller, are usually interrupted by adopting the following design: The circumferential surface of the cutting roller is provided not only with a large number of grooves of essentially rectangular cross section, but also the cutting rings or lands left standing between these grooves each possess two flanks which, together with the circumferential surface of the cutting roller, form the two cutting edges of each cutting ring. These cutting edges must be interrupted in order to avoid making a continuous incision in the longitudinal direction of the metal foil, and instead to make a large number of individual, interrupted outs. For this purpose, recesses are incorporated into the flanks of the cutting rings and these recesses extend into the area of the circumferential surface of the cutting roller, i.e. of the cutting ring, and thus form a notch in this circumferential surface which interrupts the cutting edge.

Normally, the cutting rollers are not made from a one-piece cylinder but are manufactured by assembling together a number of thin discs of alternatingly large and small diameter on a common shaft arranged concentrically to the axis of rotation of the cutting roller, so that the individual discs form alternatingly the cutting rings or the bottoms of the interlying grooves. The recesses in the flanks of the cutting rings are usually produced by milling recesses in the flanks of the discs forming the cutting rings, and these recesses are of such a shape that the notch produced in the circumferential surface of the cutting ring is rectangular in cross section. In the case of cutting rollers made from one piece, the recesses are produced by erosion machining. Therefore, this always resulted in damage to the metal foil, or the foil even became wrapped around the cutting roller or the pressure roller. Brushes, guide plates and other devices used to facilitate the removal of the cut metal strip from the cutting unit were for the most part ineffective.

In the system according to the invention, the recesses in the flanks of the cutting rings are for this reason differently shaped, namely in such a manner that their cross section; i.e. the notch visible in the ciroumferential surface of the cutting ring, is not rectangular in shape but of trapezoidal cross section, with the base of the trapezium lying on the extended line of the cutting edge. When a notch of this shape is used, the cut metal strip does not become caught up or jammed in the cutting roller. It has been found advantageous to give the sides of the trapezoidal notch an angle of 40°-75°, and most advantageously 45°, relative to the base. The cut foil emerges smoothly from such a cutting roller, regardless of whether the latter is of one-piece construction or made from individual discs forming the cutting rings and the bases of the grooves. To provide support, guide elements are additionally installed in the area of the cutting unit, e.g. wires arranged close to the foil, both above and below it, and running parallel to the longitudinal direction of the foil, i.e. they run horizontally through the grooves of the cutting and pressure rollers. Similarly, lining the grooves of the cutting roller and possibly of the pressure roller up to a certain level with elastic material, such as rubber, which was intended to force the cut metal foil out of the grooves, proved to be of incidental benefit.

On the other hand, it proved advantageous to fill the grooves of the pressure roller partially with such an elastic material, because in this way it is possible to avoid the adhesion of the foil in the grooves of the drive roller, although the adhesion is much less pronounced than in the grooves of a cutting roller designed according to the current state of the art.

Furthermore, the present invention also relates to improvements in the stretching unit by means of which the cut, strip-shaped material, which need not be metal but may be made for example of plastic foil, is expanded transversely to the longitudinal direction, which automatically results in a shortening of the strip or of the incisions in the longitudinal direction. Compared with the state of the art, in which the out metal strip is gripped at its edges and transported onwards, while at its centre it is forced to run over a ramp projecting upwards at an acute angle from the plane of the cut metal strip, the following improvements have proved to be advantageous:

To start with, instead of a ramp structure, a recirculating, essentially one-piece belt is selected having preferentially a round cross section. This belt consists preferentially of a material possessing relatively high friction in relation to the material of the cut strip, so that if this recirculating belt has a higher speed than the running speed of the metal strip, the latter is drawn upwards in its centre section by this recirculating belt, because of the good grip existing between the metal strip and the belt. However, as a rule, every effort should be made to adjust the speed of the belt to the speed of the foil, because this is the best way to avoid distorting or damaging the foil.

The lateral grip on the strip-shaped out foil has also been improved. In the state of the art equipment the foil is gripped preferentially by Reinolds conveyor chains, i.e. link chains having specially shaped links made from hard plastic. These Reinolds conveyor chains are expensive and because of the hardness of the material they are subject to higher wear than a flexible, more adaptable material, and in addition, when a contact pressure adequate to grip the foil is used, it is very easy for the foil to be damaged or for it to tear at the edges.

In the process according to the invention, instead of such conveyor chains toothed belts are used, and at least the surface of such belts is made of rubber or a rubber-like, relatively elastic material, and the teeth of the toothed belt point outwards so that the foil is gripped at the edges between the lower strand of the toothed belt running above the foil, and the upper strand of a toothed belt running below the foil, and it is transported forwards in this manner; the toothed belts run parallel over a certain distance to permit the teeth and gaps in the toothed belts to mesh with each other. It has proved advantageous to use in particular a woven toothed belt made of a plastic-textile mixture. Of course, the shape of the tooth on the toothed belt must be selected in such a manner that the shape of the teeth corresponds as closely as possible to the shape of the gaps. Furthermore, by providing adequate tensioning of the toothed belts, or also by mechanically supporting the belts for example by using supporting devices over which the meshing strands of the toothed belts run, the opposing pressure between the two belts can be set in such a way that it is strong enough to hold the foil.

This method of laterally gripping the out metal foil between toothed belts offers, however, one additional and highly decisive advantage over the Reinolds conveyor belts, which are substantially flat at their points of contact with the metal foils:

When expanding the cut, strip-shaped metal foil transversely to the longitudinal direction, not only is the foil made wider but in the longitudinal direction it becomes shorter; consequently, in a continuously operating device, with cutting and stretching units arranged in tandem and joined by the metal foil, steps must be taken to ensure that during the stretching process the running speed of the metallic foil is reduced in accordance with the shortening of the strip which takes place when it is stretched. A foil which is gripped by two intermeshing toothed belts must follow the zig-zag path of the teeth and the gaps between the teeth, therefore over a certain length of the toothed belt a larger length of strip-shaped foil, depending on the height of the teeth on the toothed belt, is gripped. Therefore, a strip-shaped foil emerging at a speed V from the cutting unit can be gripped by a toothed belt running at a lower speed V2 without causing any tension, or on the other hand without causing any back-up in the strip-shaped, cut material. When an appropriate choice of tooth shape, i.e. tooth height and tooth spacing, is made for the toothed belt, it is possible to compensate in this manner for the shortening of the foil in the longitudinal direction, so that at the emergence from the stretching unit, i.e. at the end of the intermeshing toothed belts, the speed of the finished expanded metal, as dictated by the shortening of the foil in the longitudinal direction, is the same as the speed of the toothed belts, and thus corresponds to the speed of the material emerging from the stretching unit.

When using gripping and transporting devices which lie flat on the foil, the speeds of these gripping and transporting devices are logically the same as that of the material being processed, either at the inlet of or the outlet from the stretching unit, or at any point in between, but the machinery does not reduce the speed at which the strip-shaped material being processed runs through the system.

Figure 2:
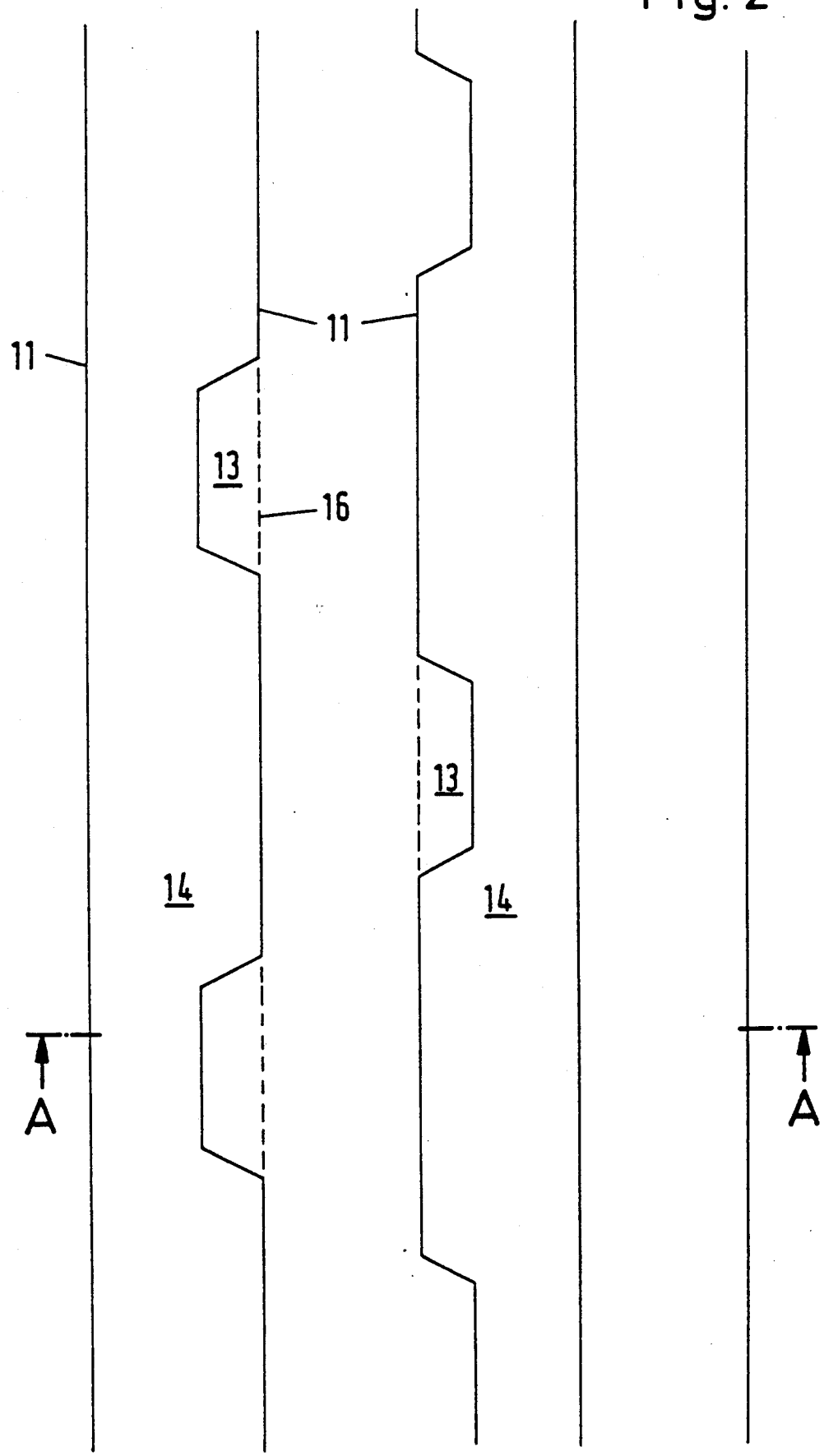
Figure 3:
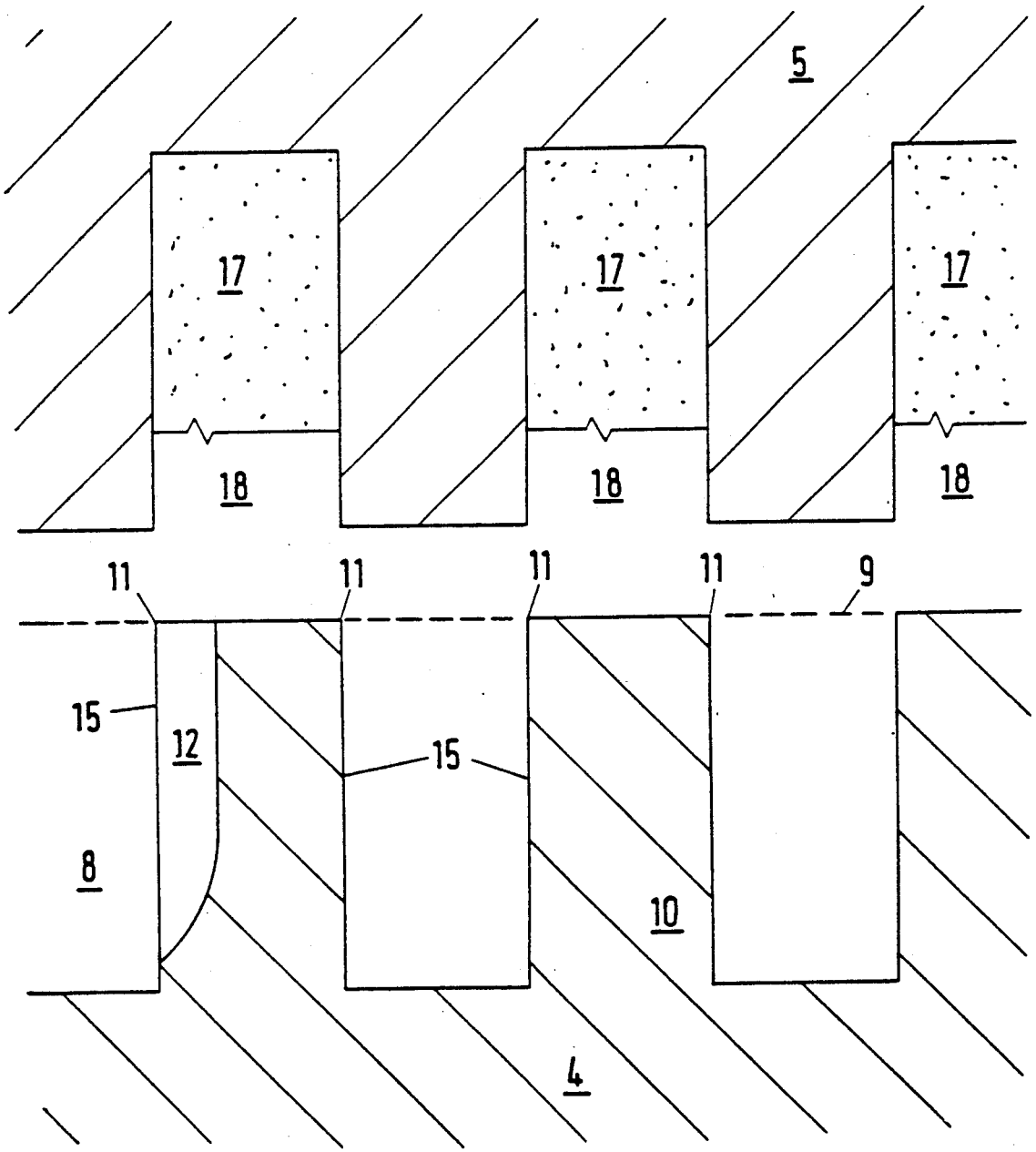

Advantageous embodiments of the invention are described in more detail in the following, with reference to the accompanying simplified diagrammatic drawings, which show:

FIG. 1: a perspective view of the cutting roller and stretching units, arranged in tandem;

FIG. 2: a developed view of the circumferential surface of the cutting roller;

FIG. 2A: a view similar to that of FIG. 2 but showing a modified embodiment of the part shown;

FIG. 3: a cross-sectional view through the cutting and pressure rollers along the section A—A in FIGS. 1 and 2, wherein the cutting roller and the pressure roller do not mesh with each other, as is customary when in operation, but are shown for the sake of clarity at a distance from each other;

FIG. 3A: a view similar to that of FIG. 3 but showing a modified embodiment of the part shown;

FIG. 4: a top plan view of the stretching unit, with the foil to be stretched, as in FIG. 1, just entering the stretching unit; and

FIG. 5: of FIG. 2.

Throughout the drawings, the corresponding parts are referred to with the same reference numbers. When needed, a plurality of the same parts of the structure is referred to with the corresponding numerals distinguished from each other by a letter.

FIG. 1 shows a tandem arrangement of a cutting unit 2 and a stretching unit 3, and it is indicated that as the foil runs continuously through these two units they must be arranged one behind the other, but not immediately so, because it is possible to interpose further facilities, for example a counter, control devices, alignment and deflection devices.

Both the cutting unit 2 and the stretching unit 3 may be mounted on a common base frame, as indicated by the number 6, or they can be mounted at different points and on different base frames, depending on the requirements of the production operation.

The position and mutual alignment of the various units depends on the position and direction of motion of the foil which is being processed; in the embodiment illustrated, the foil is running horizontally from left to right. Therefore, the cutting unit 2 consists of a pressure roller 5 and a cutting roller 4 which are arranged horizontally one above the other and intermesh with each other, and make a large number of individual incisions 7 oriented in a longitudinal direction in the foil 1 running between them. The cutting roller 4 and the pressure roller 5 are mounted on both sides in bearing blocks 19 which are in turn mounted on the base frame 6, and they are driven by drive units such as electric motors, which are not shown here.

In the cutting unit 2 shown here, the pressure roller 5 is arranged above the cutting roller 4, but the arrangement could equally well be reversed. The circumferential surface of the cylindrical cutting roller 4 is provided with a large number of substantially annular grooves 8, between which substantially annular cutting rings 10 project. In a developed view, the circumferential surfaces 14 of these cutting rings 10 exhibit a zig-zag structure, which can be better recognised in FIG. 2. This derives from the fact that the circumferential surface 9 of the cutting roller 4 contains not only a large number of said annular grooves 8 having a substantially rectangular cross section, with similarly annular cutting rings 10 disposed therebetween and oriented concentrically to the axis of rotation of the cutting roller 4. Furthermore, recesses 12 are incorporated into the flanks 15 of these cutting rings 10. The recesses 12 extend into the circumferential surface 14 of the cutting rings 10 to form notches 13 in the annular circumferential surfaces 14 of the cutting rings 10, so that the originally annular shape of the circumferential surfaces 14 of the cutting rings 10 is changed by lateral notches. As a result, the cutting edges 11 are also interrupted, without the notches 13 they would have a continuously annular shape. This makes it possible to produce individual, discontinuous incisions 1 in the longitudinal direction of transportation 38 (FIG. 4) of the strip-shaped foil 1. In the present case (see FIGS. 1 and 2), in each case only one cutting edge 11 of each cutting ring 10 is interrupted by notches 13. The cutting edges 11, interrupted by notches 13, of two adjacent cutting rings 10 are turned towards each other.

The cutting rings 10 are so wide that they fit exactly in the equally annular grooves 18 provided in the circumferential surface 9 of the pressure roller 5, so that when the cutting unit 2 is operating, the cutting rings 10 of the cutting roller 4 project partially into the grooves 18 of the pressure roller 5, and likewise the lands projecting between the grooves 18 on the pressure roller 5 engage partially in the grooves 8 of the cutting roller. As a result, as the cutting roller 4 and the pressure roller 5 both rotate and the strip-shaped metal foil runs between them, the foil 1 is sheared between the cutting edges 11 of the cutting roller and the oppositely acting edges of the lands on the pressure roller. The foil 1, which is provided in this way with a large number of individual cuts 7 arranged in the longitudinal direction 38 of transport and offset in relation to each other, runs either immediately, or after the interposing of additional units, into the stretching unit 3 where it is expanded transversely to the longitudinal direction of transport 38. The stretching unit 3 consists of two intermeshing toothed belts 30 in the area of the edges 34 of the foil 1. In each case, one of the toothed belts 30 is arranged above or below the foil 1 and is guided over at least two rollers 31 in such a manner that the lower strand of the upper toothed belt 30 and the upper strand of the lower toothed belt 30 each run parallel to the foil 1 and also parallel to the other toothed belt 30. Since the toothing on the toothed belt is selected in such a way that the size of the teeth 32 corresponds to the size of the gaps 33 between the teeth, the lower strand of the upper toothed belt 30 and the upper strand of the lower toothed belt 30 mesh with each other because of their outward oriented teeth 32 and because of the appropriate selection of the spacing between the upper and lower rollers 31. The rollers 31 ensure adequate tensioning of the toothed belts 30 so that an adequately high contact pressure is exerted by the toothed belts 30 over the entire length of their intermeshing sections, thereby gripping the edges 34 of the foil 1 and not only transporting it in the longitudinal direction of transport, but also gripping the foil firmly transversely to the longitudinal direction of transport 38 in order to bring about the desired stretching in this transverse direction.

The stretching is carried out by means of the following arrangement: When the stretching unit 3 is viewed from above, as shown in FIG. 4, a belt 35 is seen running approximately in the middle between and parallel to the toothed belts 30, and this belt passes over at least two rollers 31, whose plane 36 of rotation runs approximately in the longitudinal direction 38 of transport of the foil 1, but perpendicular to the plane of the foil 1. The upper strand 39 of this belt 35 runs obliquely upwards from below the plane of the foil 1 so that it forms an acute angle 40 (FIG. 1) with the longitudinal direction 38 of transport, and this angle corresponds preferentially to a gradient of 1:2 to 1:4, preferably 1:3, between the upper strand 39 and the plane of the foil 1. The angle of said gradient is coincident with a plane which is also referred to as "a longitudinal plane generally perpendicular to a reference plane, said reference plane being a generally planar section formed by that part of the foil which is gripped between said toothed belts". The rollers 31, by means of which this belt 35 is tensioned, are also in turn positioned in bearing blocks 19 which are mounted on the base frame 6 Similarly, this belt 35 is also driven by drive units, preferentially electric motors, in such a manner that the upper strand 39 of the belt 35 moves obliquely upwards to the right, i.e. in the direction of motion of the foil 1.

If, now, when the stretching unit 3 is operated, the foil is gripped at its edges 34 by the pairs of toothed belts 30 and transported forwards in the longitudinal direction of transport 38, then the foil 1 runs up onto the upper strand 39 (also referred to as "foil engaging strand") of the belt 35 and the foil 1 is thereby stretched transversely to the longitudinal direction of transport as the gradient of the upper strand of belt 35 increases; the latter belt is preferentially round in cross section and has a diameter in the order of 25 mm. In order to permit the foil to run up smoothly on the belt 35, the speed of the belt 35 should at least correspond to that of the toothed order to guarantee adequate friction and thus driving force between the belt 35 and the material of the foil which is to be cut.

When selecting the toothed belt 30, it is advisable to ensure that not only the tooth profile guarantees that the teeth 32 and the gaps between the teeth 33 of the toothed belts 30 intermesh, but also the hardness of the material from which the toothed belt is made must be carefully selected to guarantee that adequate gripping force is exerted on foil 1. It has been found that the most advantageous choice of rubber toothed belts is one having a Shore hardness of about 60.

When this choice of parameters is made, the device for producing expanded material can be used without any problems to cut and stretch, for example, aluminium foils between 3/100 mm and 12/100 mm thick.

Of course, in order to achieve this and to guarantee continuous interaction of the cutting unit 2 and the stretching unit 3, the speed of rotation of the toothed belts 30 as well as of belt 35 (also referred to as "a stretching belt") must be matched to the speed of rotation of the cutting roller 4 and the pressure roller 5. Because of the folding of the foil 1 around the teeth of the toothed belts 30, the speed of rotation of the toothed belts 30 is lower than the speed of the arriving, cut foil 1, but the amount by which the speed is reduced depends on the spacing and height of the teeth 32 on the toothed belt 30.

Both in the right half of FIG. 1 as well as in FIG. 4, the foil 1 is depicted solely up to the start of the stretching unit 3, so as not to impair the depiction of the other parts of the device.

Furthermore, FIGS. 2 and 3 contain detailed depictions of the cutting roller 4. FIG. 2 shows a developed view of the circumferential surface 9 of the cutting roller 4, or more precisely the circumferential surface 14 of the cutting rings 10 of the cutting roller 4 which are left between the grooves 8, the latter being arranged annularly and concentrically to the axis of rotation of the cutting roller 4; these grooves 8 have a preferably rectangular cross section, as can best be seen in FIG. 3.

These cutting rings 10 each possess two flanks which together with the circumferential surfaces 14 of the cutting rings 10 form the annular cutting edges 11 and these, in conjunction with the flanks of the grooves 18 of the pressure roller 5, cause the foil 1 to be sheared. However, for this purpose, the cutting roller 4 and the pressure roller 5 must be arranged so closely together that grooves 8 or 18 as well as the interlying lands of the two rollers partially mesh with one another. In contrast, the cutting roller 4 and the pressure roller 5 are shown spatially separated in FIG. 3 in order to simplify the depiction and identification of the individual surfaces and edges.

The notches 13 in the circumferential surfaces 14 of the cutting roller 1, which are visible in FIG. 2, are formed by the recesses of which only one recess 12A is visible in FIG. 3. As mentioned above these recesses also project as far as the circumferential surface 14 of the cutting rings 10 and thus form the notches 13.

As far as the effect on the foil 1 is concerned, the main factor is the shape of the notch 13, as shown in FIG. 2, and not so much the configuration of the recess 12 in the lower portion of the flanks 15 in FIG. 3.

The shape of the recesses 12 shown in FIG. 3 is preferentially obtained when, as shown in FIG. 3A, the cutting roller 4 consists of individual discs of alternatingly large and small diameter, which are joined together one after another in an axial direction to form the cutting roller 4. Before the discs are assembled, the aforementioned recesses 12 are provided in the flanks 15 of the discs which later form the cutting rings 10, and this is done by means of a milling cutter so that the bottom of the recesses 12 in the lower region of the flanks 15 has an arcuate configuration. However, these recesses 12 can also be prepared in another manner, which is required mainly when the cutting roller 4 is not made up of individual discs but is produced form a single cylindrical piece. This embodiment is shown in FIG. 3.

Similarly, in FIG. 3, which depicts a cross sectional view along the lines A—A in FIGS. 1 and 2, it can be seen that the grooves 18 of the pressure roller 5 are partially filled with rubber 17 which is compressed by the action of the cutting rings 10 as the foil 1 is being cut; subsequently, the rubber expands again to its original shape, thereby forcing out the foil which is partially located in the groove 18.

In the state of the art equipment, on the other hand, it was necessary to put rubber or other elastic material in the grooves 8 of the cutting roller 4 in order to force the foil 1 out of these grooves 8, because the foil 1 often became caught up in the recesses 12 of the cutting rings 10, so that when it emerged from the cutting unit 2, additional, unintended tears occurred in the foil 1, often causing breaks in cross-connecting pieces or even tearing the entire foil 1, so that it was not possible to further process it into expanded metal. Such faults are particularly disruptive during continuous operations because, if any faults also occur in the functioning of the stretching unit 3, the whole installation frequently has to be shut down or a high reject rate is incurred.

The hooking of the foil 1 in the recesses 12 seems to be due to the fact that, in the state of the art equipment the notches created by the recesses 12 in the circumferential surfaces 14 were rectangular in cross section In contrast, in the method according to the invention, these recesses 12 are designed in such a way that their cross section, and thus the notch 13 in the circumferential surface 14 of the cutting rings 10, is trapezoidal in shape, and the base of the trapezium lies along the extended line of the cutting edges 11. The sides 41 of these trapezoidal notches are arranged preferentially at the same angle 43 of preferentially 40° to 75°, and in particular 45° relative to the base 42 of the trapezium, as shown in FIG. 5.

As a result of this inclination of the sides of the recesses 12, the foil 1 runs so smoothly and without tearing from the cutting unit that both the elastic inlays in the grooves 8 of the cutting roller 4, as well as the stripping brushes and other types of guide fitted at the exit from the cutting unit, and also the rubber inserts in the cutting rollers, need only be fitted as further optional refinements.

Those skilled in the art will appreciate that many modifications of the embodiment described above may be carried out without departing from the present invention. Accordingly, I wish to protect by letters patent granted on this application all such embodiments as properly fall within the scope of my contribution to the art.

The embodiments of the invention in which an exclusive right or privilege is claimed are defined as follows:

1. A device for manufacturing expanded material from foil, in particular expanded metal from aluminum foil, comprising a cutting unit to continuously produce individual, discontinuous cuts in the foil, the cutting unit includes a cylindrical cutting roller and a pressure roller and a stretching unit for expanding the cut foil transversely to the longitudinal direction of the cuts, wherein grooves (8) are provided in the cylindrical cutting roller (4) and the cylindrical pressure roller (5) includes grooves (18) arranged annularly in the circumferential surfaces of the cutting roller (4) and the pressure roller (5).

2. A device according to claim 1, wherein the grooves (18) are filled at least partially with an elastic material.

3. A device according to claim 1, wherein the belt (35) is made of one of either rubber or PVC.

4. A device for manufacturing expanded material from foil, in particular expanded metal from aluminum foil, comprising a cutting unit for the continuous production of individual, discontinuous incisions in a foil, wherein the cutting unit includes a cutting roller and a pressure roller, and a stretching unit for expanding the cut foil transversely to the longitudinal direction of the cuts, wherein:

a) in the cutting unit (2), the cutting roller (4) is essentially cylindrical in shape and possesses a large number of grooves (8) of a generally rectangular cross section in a circumferential surface (9) of the cutting roller (4), so that lands forming cutting rings (10) having flanks are left standing between the grooves (8), b) the flanks (15) of the cutting ribs (10) possess several recesses (12) which extend into the circumferential surface (14) of the cutting ring (10), the recesses of the flanks of two adjacent rings which forms any one of said grooves being located in an alternating position so that, at any point of the periphery of the respective groove, there is a recess in only one of the two flanks whereby only one of respective two opposed cutting edges (11) of the cutting ring (10) is interrupted by a recess (12), c) the recesses (12) are shaped in such a way that trapezoidally shaped notches are formed in the circumferentaial surface (14) of the cutting ring (10), and d) the cylindrical pressure roller (5) similarly possesses a large number of annular grooves (18) whose quantity and dimensions are matched to the grooves (8) of the cutting roller (4) so that through the intermeshing of the grooves (8, 18) and the lands of the cutting and pressure rollers (4) and (5), the foil passing between them is cut.

5. A device according to claim 1, wherein the notches are defined by a pair of sides enclosing an angle of 40° to 75°, and in particular 45°.

6. A device according to claim 1, wherein the notches are defined by sides which enclose angles of equal size.

7. A device according to claim 1, including guide wires strung above and below and in the longitudinal direction of the foil (1), and located in the grooves of the cutting roller (4) or the pressure roller (5).

8. A device for producing expanded material from foil, in particular expanded metal from an aluminum foil, comprising a cutting unit to continuously produce individual discontinuous cuts in a foil, the cutting unit including a cutting roller, a pressure roller, and a stretching unit for expanding the cut foil transversely to the longitudinal direction of the cuts, and wherein:

a) the stretching unit (3) possesses two pairs of toothed belts (30) which grip the two edges (34) of the foil (1) and transport the latter in a longitudinal direction; one toothed belt (3) runs above and the other below each edge (34) of the foil (1) in the same plane perpendicular to the foil (1), which the teeth (32) oriented outwards, so that the upper and lower toothed belts (30) respectively run parallel to each other over a certain distance, thereby permitting their teeth (32) and the gaps between their teeth (33) to intermesh and thus gripping in each case an edge of the foil (1) between them and transporting the foil longitudinally, b) at least one belt (35) for transversely stretching the foil, said at least one belt circulating around at least two rollers (31) in a plane perpendicular to the plane of the foil (1) and in the longitudinal direction of transport (38), a length (39) of the belt (35) rising at an acute angle (40) relative to the longitudinal direction of transport (38) from below the plane of the foil (1) and the speed of the belt (35) being at least greater than or the same as that of the arriving foil (1).

9. A device according to claim 8, wherein the belt (35) is of round cross section and has a diameter of approximately 33 mm.

10. A device according to claim 8, characterized by the fact that the belt (35) runs at a speed corresponding to the speed of arrival of the foil (1).

11. A device according to claim 8, wherein the belt (35) is made of a material having high coefficient of friction relative to the material of the foil.

12. A device according to claim 8, wherein the toothed belts (3) posses trapezoidal teeth and the associated spaces (33) between the teeth correspond in shape and size to the teeth (32).

13. A device according to claim 8, wherein the tooth belts (30) are made of rubber having a Shore hardness of 50–70.

14. A device according to claim 8, wherein the foil (1) is transversely stretched in the stretching unit (3) preferentially by a factor of 1.3 to 2.0.

* * * * *